US008561703B2

(12) United States Patent
Mahmoud et al.

(10) Patent No.: US 8,561,703 B2
(45) Date of Patent: Oct. 22, 2013

(54) COMPLIANT DART-STYLE REVERSE-FLOW CHECK VALVE

(75) Inventors: Abdel-Rahman Mahmoud, Sugar Land, TX (US); Kevin T. Scarsdale, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 430 days.

(21) Appl. No.: 12/813,728

(22) Filed: Jun. 11, 2010

(65) Prior Publication Data

US 2010/0319924 A1 Dec. 23, 2010

Related U.S. Application Data

(60) Provisional application No. 61/187,680, filed on Jun. 17, 2009.

(51) Int. Cl.
*E21B 34/00* (2006.01)

(52) U.S. Cl.
USPC ..... 166/325; 166/316; 166/285; 137/515.5; 137/542; 285/315; 285/319; 285/921

(58) Field of Classification Search
USPC ..... 166/316, 325, 285, 515, 181, 327, 318; 417/112, 115, 117; 137/112, 115, 117; 285/315, 319, 921
See application file for complete search history.

(56) References Cited

U.S. PATENT DOCUMENTS

| | | | | |
|---|---|---|---|---|
| 3,489,170 | A | 1/1970 | Leman | |
| 4,111,608 | A * | 9/1978 | Elliott et al. | 417/112 |
| 4,624,316 | A * | 11/1986 | Baldridge et al. | 166/325 |
| 4,951,707 | A | 8/1990 | Johnson | |
| 5,193,577 | A | 3/1993 | de Koning | |
| 5,707,214 | A | 1/1998 | Schmidt | |
| 2009/0044948 | A1 | 2/2009 | Avant et al. | |

* cited by examiner

*Primary Examiner* — Yong-Suk Ro
(74) *Attorney, Agent, or Firm* — Jim Patterson

(57) ABSTRACT

An apparatus usable with a well includes a gas lift valve having a check valve arrangement located between an annulus and a passageway of a tubing. The check valve arrangement is adapted to selectively allow fluid flow from the check valve arrangement from an inlet side of the check valve arrangement to an outlet side of the check valve arrangement, and is biased to prevent a leakage flow through the check valve arrangement from the outlet side to the inlet side. The check valve arrangement is defined by a valve element movable into and out of engagement with a valve seat wherein one of the valve element and the valve seat has a first sealing structure engageable with a second sealing structure on the other of the valve element and the valve seat. At least one of the first and second sealing surfaces include at least one pair of sealing members.

19 Claims, 16 Drawing Sheets

COMPLIANT DART-STYLE REVERSE-FLOW CHECK VALVE

CROSS REFERENCE TO RELATED APPLICATION

This application relates to and claims priority from U.S. Provisional Application Ser. No. 61/187,680, filed Jun. 17, 2009, which is fully incorporated herein by reference.

FIELD

The present disclosure generally relates to check valves used in connection with petroleum extraction operations and associated devices. More particularly, the disclosure relates to a dart-style reverse-flow check valve such as provided in gas lift valves utilized in an oil well downhole environment.

BACKGROUND

For purposes of communicating well fluid to a surface of a well, the well may include a production tubing. More specifically, the production tubing typically extends downhole into a wellbore of the well for purposes of communicating well fluid from one or more subterranean formations through a central passageway of the production tubing to the well's surface. Due to its weight, the column of well fluid that is present in the production tubing may suppress the rate at which the well fluid is produced from the formation. More specifically, the column of well fluid inside the production tubing exerts a hydrostatic pressure that increases with well depth. Thus, near a particular producing formation, the hydrostatic pressure may be significant enough to substantially slow down the rate at which the well fluid is produced from the formation.

For purposes of reducing the hydrostatic pressure and thus enhancing the rate at which fluid is produced, an artificial lift technique may be employed. One such technique involves injecting gas into the production tubing to displace some of the well fluid in the tubing with lighter gas. The displacement of the well fluid with the lighter gas reduces the hydrostatic pressure inside the production tubing and allows reservoir fluids to enter the wellbore at a higher flow rate. The gas to be injected into the production tubing typically is conveyed downhole via the annulus (the annular space surrounding the production tubing) and enters the production tubing through one or more gas lift valves.

As an example, FIG. 1 depicts a prior art gas lift system 10 that includes a production tubing 14 that extends into a wellbore. For purposes of gas injection, the system includes a gas compressor 12 that is located at the surface of the well to pressurize gas that is communicated to an annulus 15 of the well. To control the communication of gas between the annulus 15 and a central passageway 17 of the production tubing 14, the system may include several side pocket gas lift mandrels 16 (gas lift mandrels 16*a*, 16*b* and 16*c* depicted as examples). Each of the gas lift mandrels 16 includes an associated gas lift valve 18 (gas lift valves 18*a*, 18*b* and 18*c* depicted as examples) for purposes of establishing one way fluid (gas) communication from the annulus 15 to the central passageway 17. As is well known, the gas lift valves 18*a*, 18*b* and 18*c* are commonly installed and retrieved from mandrel side pockets, such as by using a wireline and kickover tool inserted within the production tubing 14.

The gas lift valve 18 typically contains a check valve arrangement having a check valve element that opens to allow fluid flow from the annulus 15 into the production tubing 14 and closes when the fluid would otherwise flow in the opposite direction. Thus, when the pressure in the production tubing 14 exceeds the annulus pressure, the valve element is closed to ideally form a seal to prevent any reverse flow from the tubing 14 to the annulus 15. The prior art check valve arrangements are defined essentially by a single pair of sealing surfaces. One of the sealing surfaces belongs to a seat which is generally fixed in a housing or the like. The other sealing surface belongs to a valve element that is typically spring biased and moved back and forth in and out of engagement with the seat to close and open the check valve arrangement depending on a fluid pressure differential. The valve element could be a ball, a dart (or poppet), a flapper, a diaphragm, etc. In certain high temperature working conditions such as in an oil well environment, it is common to use dart-type check valve arrangements where substantially only metal-to-metal sealing elements are used. Metal-to-metal sealing is mainly dependent on conformity between sealing surfaces, surface finish, and contact stresses. Contact stresses are functions of applied pressure and contact area. The present inventors have found that a challenge can arise when a particular check valve arrangement is required to perform steadily at low back pressures and over a wide range of back pressures. If the contact area is too small once the valve is subject to high pressure, it is plastically or non-reversibly deformed. If the contact area is too large, the valve arrangement can experience low contact stresses at low pressure and thus will not seal.

SUMMARY

The present inventors have recognized that the prior art does not adequately provide the desired sealing behavior for check valve arrangements defined by a single pair of sealing surfaces such as typically used in downhole well environments and subjected to widely varying pressure extremes in operation. Accordingly, the present disclosure relates to solutions generally addressing issues having to do with an effective sealing action within a wide range of applied back pressures, typically 100-10,000 pounds per square inch (psi) on check valve arrangements which prevent reverse flow of fluid such as from the tubing to the annulus in a well application. The check valve arrangement contemplated by the inventors provides multiple dedicated sealing surfaces designed to prevent non-reversible deformation and leakage regardless of the applied back pressures over wide operating ranges.

In one example, an apparatus usable with a well includes a gas lift valve having a check valve arrangement located between an annulus and a passageway of a tubing. The check valve is adapted to selectively allow a fluid flow through the check valve arrangement from an inlet side of the check valve arrangement to an outlet side of the check valve arrangement, and is biased to prevent a leakage flow from the check valve from the outlet side to the inlet side. The check valve arrangement is defined by a valve element movable into and out of engagement with a valve seat wherein one of the valve elements and the valve seat has a first sealing structure engageable with a second sealing structure on the other of the valve element and the valve seat. At least one of the first and second sealing structures include at least one pair of sealing members.

The check valve arrangement is adapted to establish one-way flow of gas from the annulus to the passageway of the tubing and responds to a pressure differential therebetween. The valve seat is commonly formed by internal structure of the gas lift valve and includes a high pressure seat portion and a low pressure seat portion. In certain embodiments, the valve element has a high pressure dart portion engageable with the high pressure seat portion, and a lower pressure dart portion engageable with the lower pressure seat portion. The high pressure seat portion and the low pressure seat portion may be stationary or may be movably mounted relative to one another. The low pressure dart portion and the high pressure dart portion may be integral or may be movable relative to one another.

DETAILED DESCRIPTION

In the following description, certain terms have been used for brevity, clearance and understanding. No unnecessary limitations are to be implied therefrom beyond the requirement of prior art because such terms are used for descriptive purposes and are intended to be broadly construed. The different configurations and methods described herein may be used alone or in combination with other configurations, systems and methods. It is to be expected that various equivalents, alternatives and modifications are possible within the scope of the appended claims.

Figure 1:
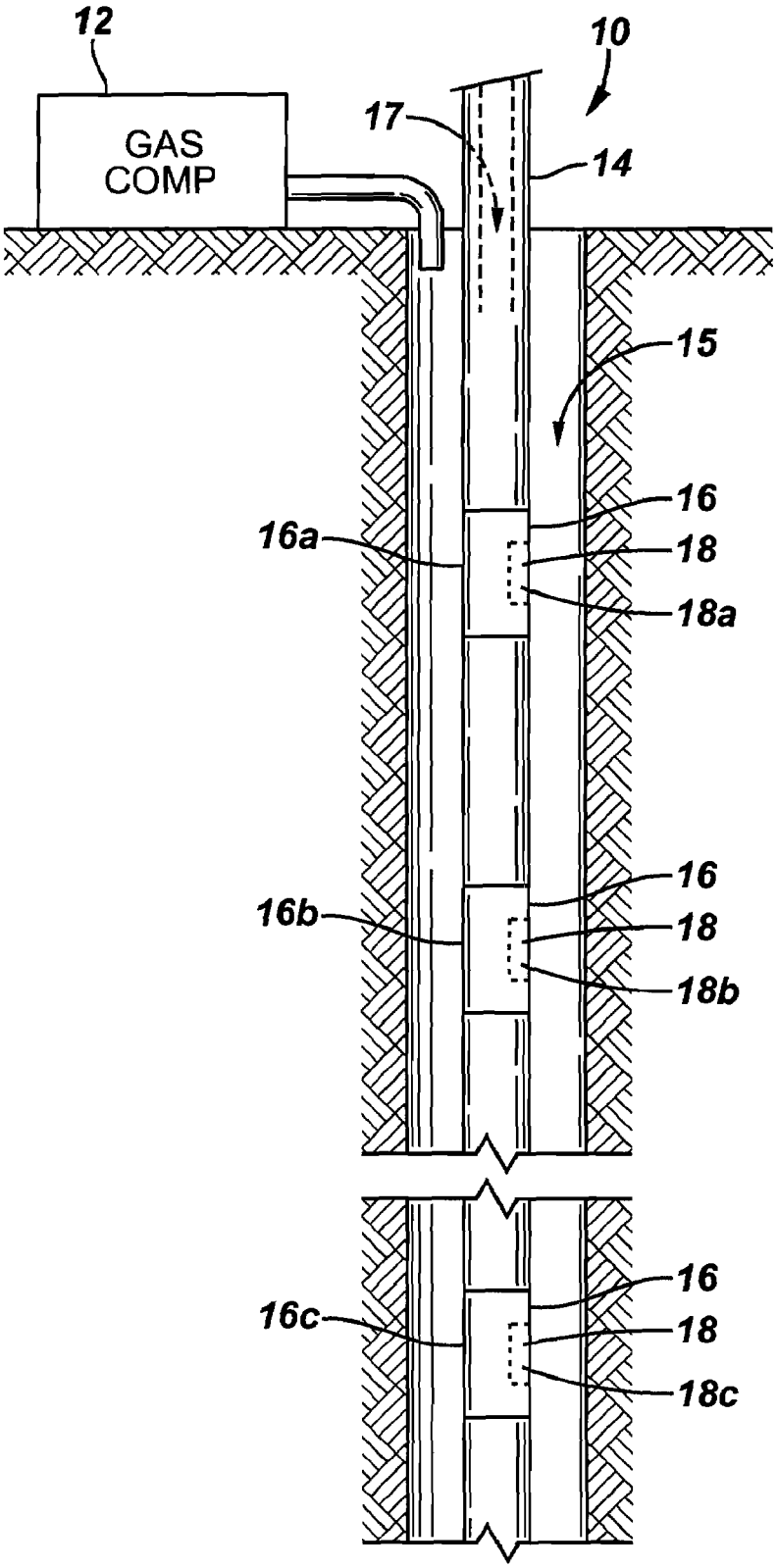
FIG. 1 (Prior Art)
FIG. 1 is a schematic diagram of a prior art gas lift system used in a well.
Figure 2:
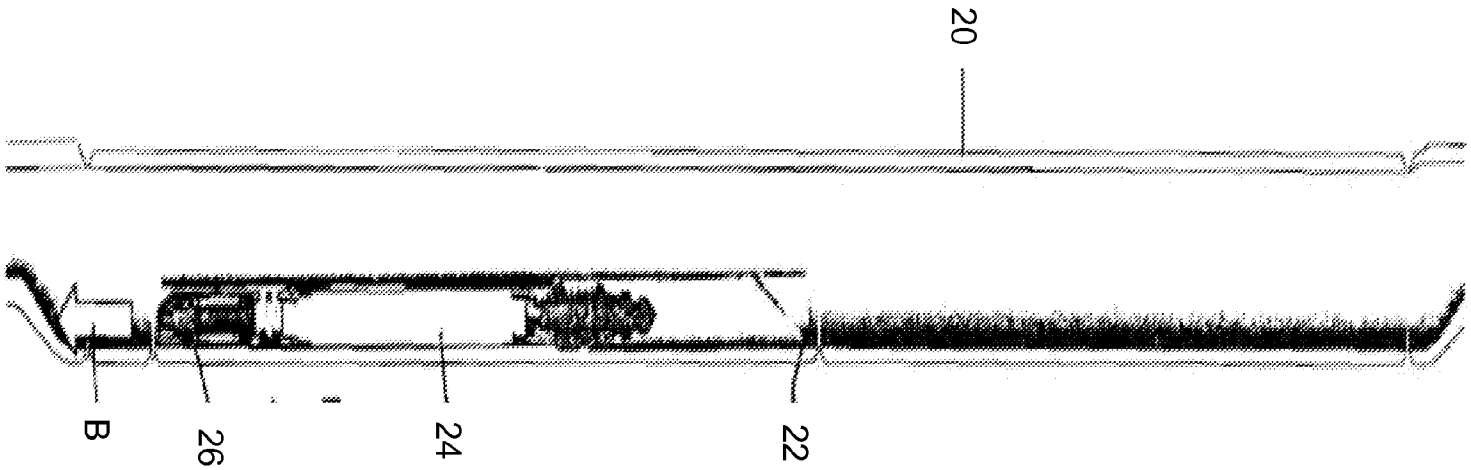
FIG. 2 is a fragmentary view of a mandrel having a gas lift valve provided with a check valve arrangement according to the present disclosure.

Referring now to the drawings, FIG. 2 illustrates a mandrel 20 having a side pocket 22 provided with a gas lift valve 24 used to regulate fluid flow of gas between an annulus and a central passageway of a production tubing in a well. A lower portion of the gas lift valve 24 includes a check valve arrangement 26 that opens to allow fluid flow from the annulus into the production tubing and closes when the fluid would otherwise flow in the opposite direction. As is well known, gas from the annulus is communicated through aligned inlets in the mandrel 20 and gas lift valve 24, as depicted by arrow A. The fluid, as regulated by the check valve arrangement 26, flows to outlets that deliver the fluid via the mandrel 20 into the production tubing as represented by arrow B.

In the examples to follow, unless otherwise noted, the check valve arrangement utilizes metallic sealing elements as generally dictated by high temperature working environments, such as downhole in an oil well.

FIGS. 3 and 3*a*-3*c* show one example of check valve arrangement 26 having an outer compliant dart check mounted in a lower portion of the gas lift valve 24. The gas lift valve 24 has an inlet section 28 attached to a tubular housing 30 which, in turn, is connected on its bottom end to a downwardly tapering check valve housing 32. The inlet section 28 has a series of radial inlet ports 34 which receive fluid (gas) that flows from the annulus through a venturi passageway 36 formed in a venturi housing 38 that is sealed to the inlet section 28, such as by O-ring 40, and supported at the top of housing 30. The venturi passageway 36 minimizes turbulence in the flow of gas from the well annulus to the production tubing, and is in communication with a tubular lower passageway 42 that extends into the check valve housing 32. Gas that flows into the check valve housing 32 exits through longitudinally extending outlets 44 that are in communication with mandrel outlets so that gas may be delivered into the production tubing. The gas lift valve 24 includes a seal 46 that circumscribes the tubing housing 30 for the purpose of forming a sealed region that contains the radial inlet ports 34 and aligned inlet ports of the mandrel 20.

The check valve arrangement 26 includes an annular valve seat 48 formed by a lowermost end of the gas valve housing 30 with the seat being opened and closed for controlling the one-way flow through gas lift valve 24 via a spring biased check valve assembly 50. As more clearly seen in FIG. 3*a*, the valve seat 48 is defined by a high pressure seat 52 and a low pressure seat 54. In the exemplary embodiment of FIG. 3, the check valve assembly 50 has a circular stepped dart body 56 which is slidably mounted in a tubular receiver 58 provided in the check valve housing 32. The dart body 56 has a lower end 60 which is slidably positioned within an opening 62 formed in the bottom end of the check valve housing 32. The dart body 56 further has a radially enlarged upper end 64 having a central recess 66 which extends downwardly therein.

Figure 3:
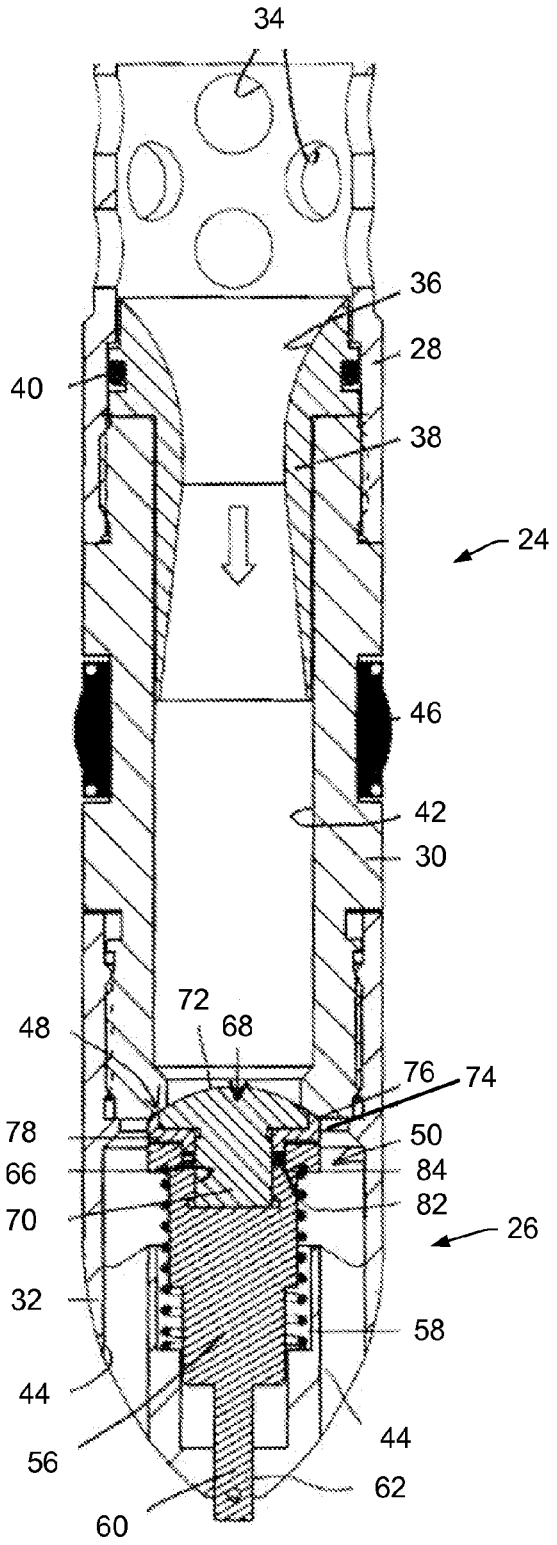
FIG. 3 is an enlarged, fragmentary sectional view of a gas lift valve shown in FIG. 2 with one example of the check valve arrangement.
Figure 3A:
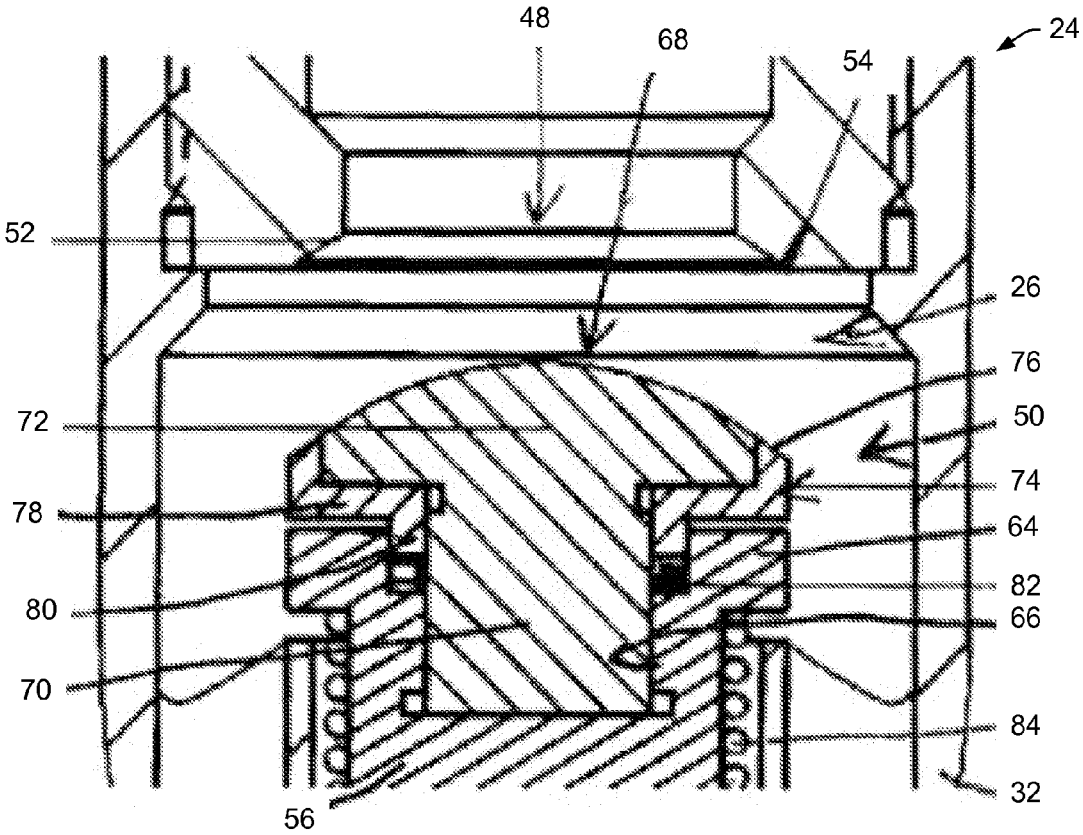
FIG. 3*a* is a partial detail view of the check valve arrangement of FIG. 3 in an open condition.

A high pressure dart portion 68 is constructed with a stem 70 that is received and fixed in the recess 66 and has a domed portion 72 selectively engageable with the high pressure seat 52. As seen in FIG. 3*a*, a low pressure dart portion 74 has a sealing surface 76 that encircles the domed portion 72 and also has a ring section 78 with a neck section 70 that is interposed between the domed portion 72 and the upper end 64 of dart body 56. The sealing surface 76 of low pressure dart portion 74 is selectively engageable with low pressure seat 54. An elastic element, such as spring 82, surrounds the stem 70 and is positioned between the neck section 78 of dart portion 74 and an upper portion of dart body 56 to provide a preload spring force on low pressure dart portion 74. The low pressure dart portion 74 has limited movement between the domed portion 72 of high pressure dart portion 68 and the upper end 64 of dart body 56. A coil spring 84 surrounds the dart body 56 and has opposite end engaged against respective shoulders on the receiver 58 and the radially enlarged upper end 64.

Figure 3B:
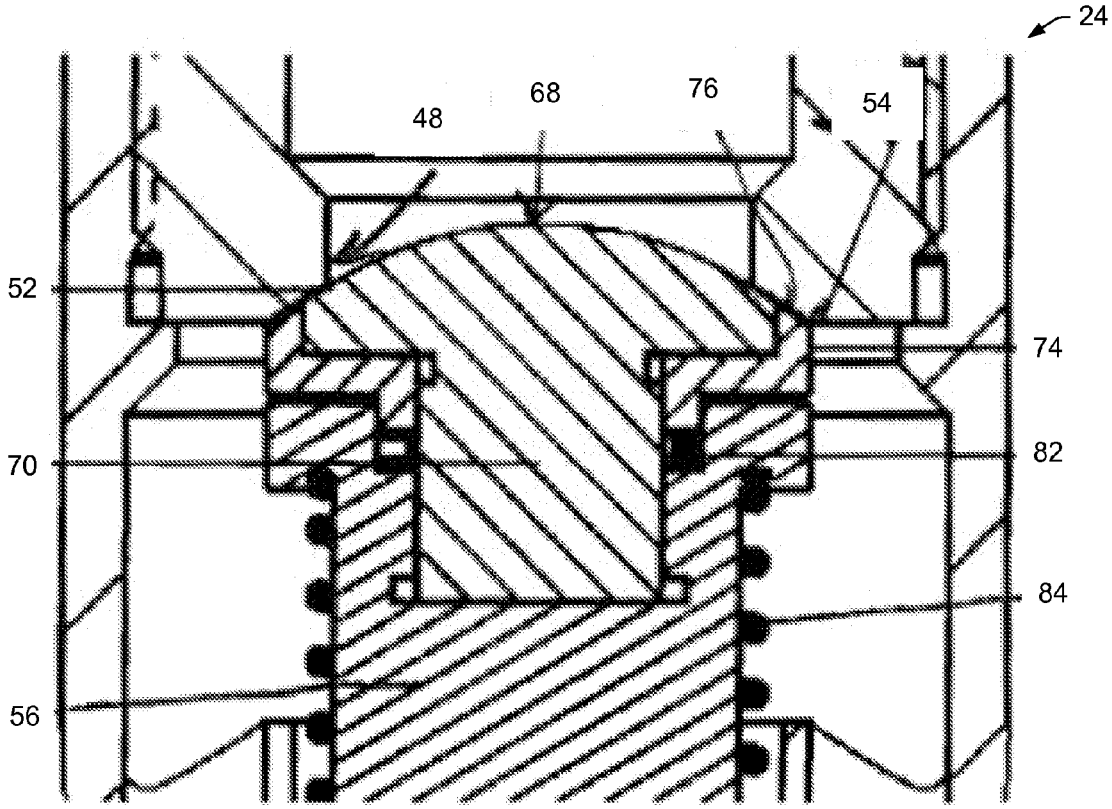
FIG. 3*b* is a partial detail view of the check valve arrangement of FIG. 3 in a low pressure sealing condition.
Figure 3C:
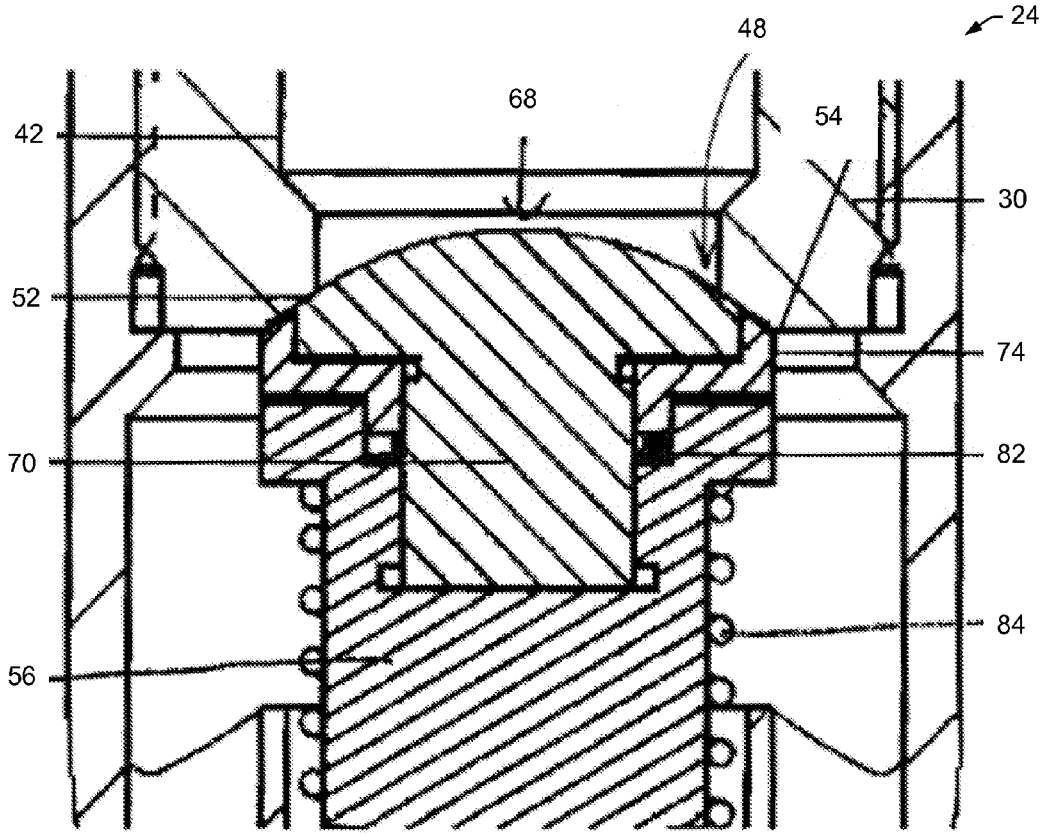
FIG. 3*c* is a partial detail view of the check valve arrangement of FIG. 3 in a high pressure sealing condition.

Spring 84 normally operates to exert an upward force on check valve assembly 50 to close off fluid communication through the valve seat 48 as shown in FIG. 3*c*. When the check valve assembly 50 is installed in the gas lift valve 24, no gas is being delivered and the production tubing pressure in the check valve housing 32 acting on the backside of the check valve assembly 50 is greater than the annulus or casing pressure in the gas lift housing 30. However, when gas begins to be pumped, the annulus or casing pressure is increased relative to the production tubing pressure to exert a force on the check valve assembly 50 to overcome the bias of spring 84. As a result, the dart body 56 along with high pressure dart portion 68 and low pressure portion 74 abruptly pops open (FIG. 3*a*) and retracts from seat 48 as spring 84 compresses to permit gas flow from the annulus through the gas lift valve 24 and check valve housing 32 into the mandrel 20 and the production tubing.

When the gas flow into the gas lift valve 24 is reduced and eventually shut off, the spring 84 returns the check valve assembly 50 towards seat 48. As the casing or annulus pressure decreases, a pressure differential is created with a low back pressure initially acting on the valve assembly 50 and causing sealing surface 76 of low pressure dart portion 74 to seal against low pressure seat 54 as shown in FIG. 3*b*. The narrow contact area between the low pressure sealing surface 76 and the low pressure seat 54 ensures a level of contact stress sufficient to seal off any leak. As back pressure increases from a low level to a high level, the dart body 56 pushes the high pressure dart portion 68 into engagement against the high pressure seat 52 and compresses the spring element 82 against the low pressure dart portion 74 and the low pressure seat 54 as depicted in FIG. 3*c*. The check valve assembly 50 is now fully closed against seat 48 so that no reverse flow is permitted from the tubing to the annulus. Even at high back pressure, the low pressure dart/seat pair 76 and 54 will only be subject to a slightly higher level of contact stresses than it experiences at low pressure. This level of contact stress is designed to spare the low pressure dart/seat pair 76 and 54 from deformation.

Figure 4:
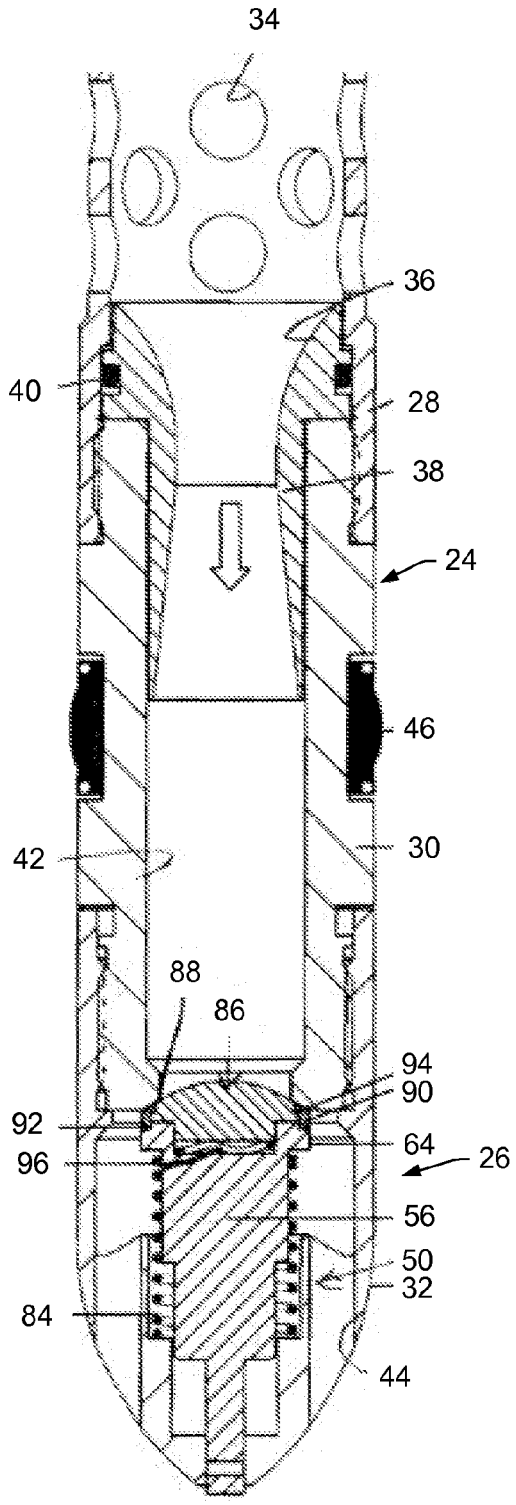
FIG. 4 is an enlarged fragmentary sectional view of the gas lift valve shown in FIG. 2 with another example of a check valve arrangement.
Figure 4A:
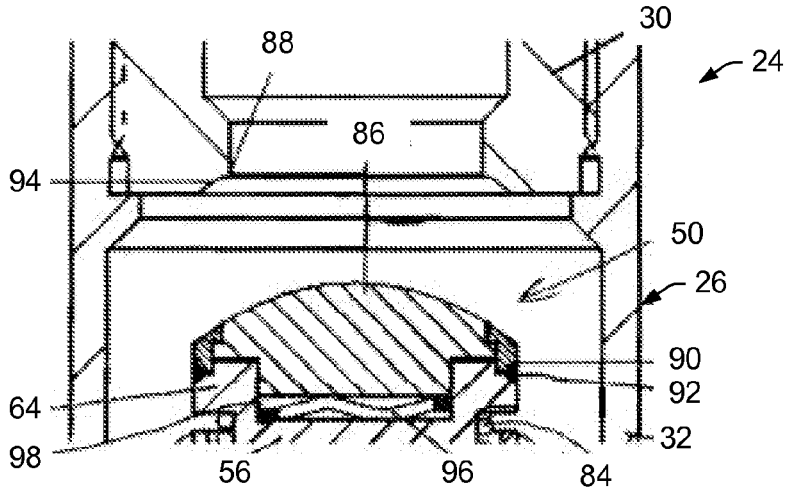
FIG. 4*a* is a partial detail view of the check valve arrangement of FIG. 4 in an open condition.
Figure 4B:
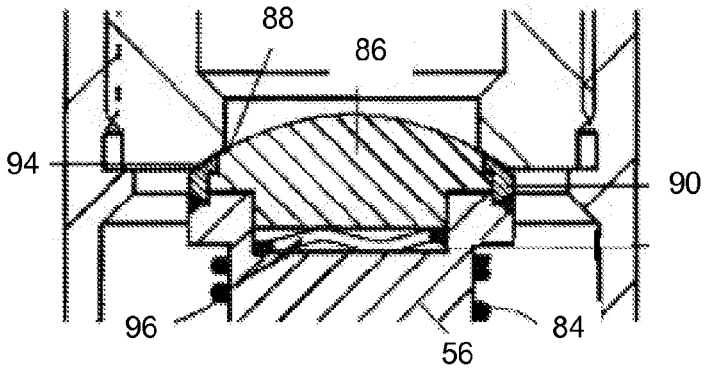
FIG. 4*b* is a partial detail view of the check valve arrangement of FIG. 4 in a low pressure sealing condition.
Figure 4C:
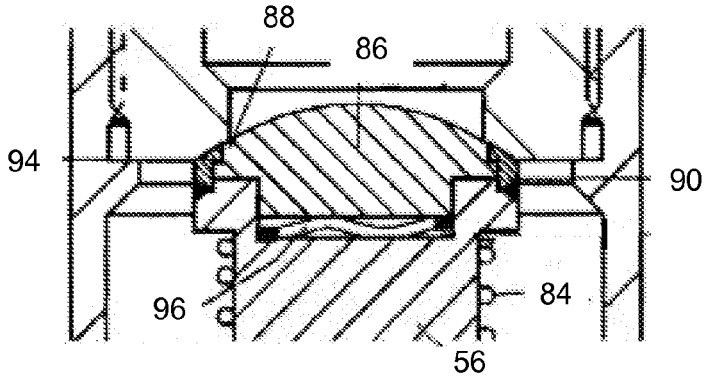
FIG. 4*c* is a partial detail view of the check valve arrangement of FIG. 4 in a high pressure sealing condition.

FIGS. 4 and 4*a*-4*c* show another example of a check valve arrangement 26 having an inner rather than outer compliant dart valve mounted in the lower portion of gas lift valve 24. In this example, the check valve assembly 50 employs a low pressure dart portion 86 that is selectively engageable with a low pressure seat 88. A high pressure dart portion 90 is fixed by a weldment 92 to upper end 64 of dart body 56, and is selectively engageable with a high pressure seat 94. A wave spring 96 is interposed in a recess 98 between the dart body 56 and the low pressure dart portion 86, and provides a preloaded spring force on low pressure dart portion 86 which is mounted for limited movement relative to high pressure dart portion 90. Operation is similar to that of the example of FIGS. 3*a*-3*c*. After opening of the check valve assembly 50 as seen in FIG. 4*a*, the low back pressure causes initial sealing of low pressure dart portion 86 against low pressure seat 88 aided by wave spring 96 (FIG. 4*b*). Subsequently, high back pressure causes high pressure dart portion 90 to seal against high pressure seat 94 (FIG. 4*c*).

Figure 5:
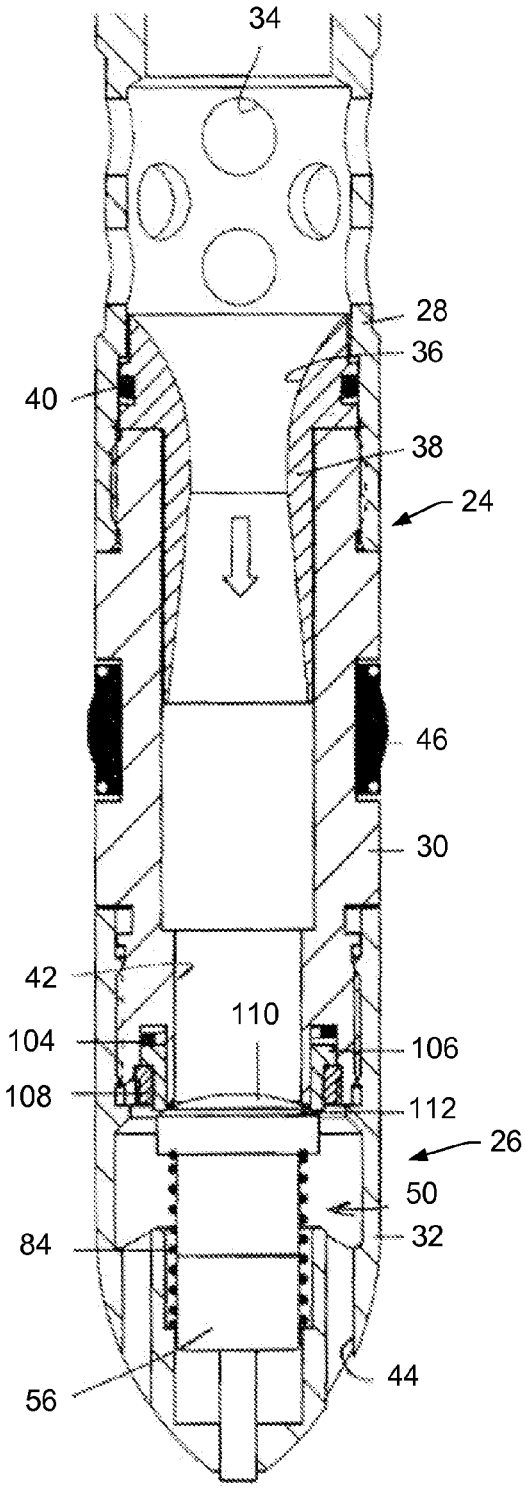
FIG. 5 is an enlarged fragmentary sectional view of the gas lift valve of FIG. 2 with another example of check valve arrangement.
Figure 5A:
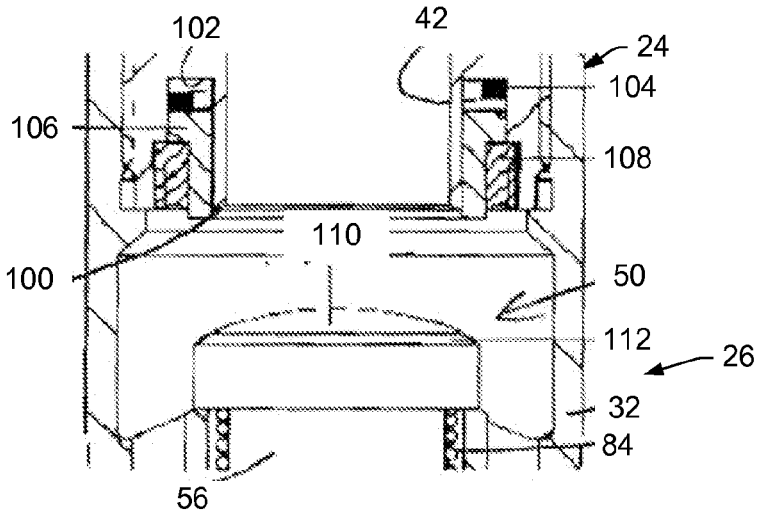
FIG. 5*a* is a partial detail view of the check valve arrangement of FIG. 5 in an open condition.
Figure 5B:
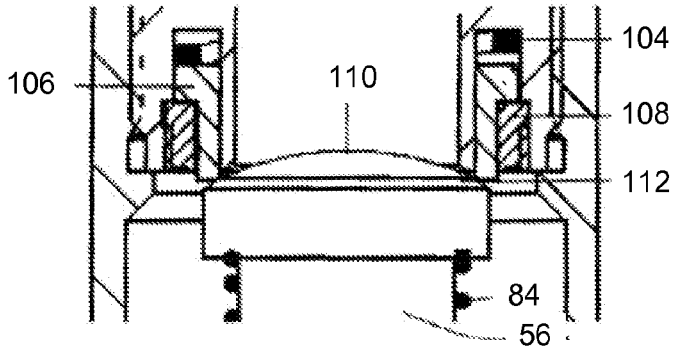
FIG. 5*b* is a partial detail view of the check valve arrangement of FIG. 5 in a low pressure sealing condition.
Figure 5C:
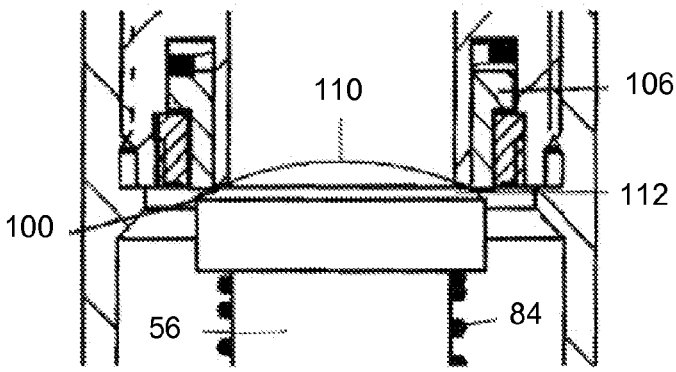
FIG. 5*c* is a partial detail view of the check valve arrangement of FIG. 5 in a high pressure sealing condition.

FIGS. 5 and 5*a*-5*c* show a further example of a check valve arrangement 26 having an outer compliant seat check. Here, a fixed high pressure seat 100 is defined by a lowermost tip of gas lift valve housing 30. A groove 102 machined in the bottom end of the gas lift valve housing 30 is provided with an annular wave washer or spring 104 which normally exerts a downward biasing force on a movable annular low pressure seat 106 engageable with a retainer nut 108. The low pressure seat 106 is located outside the flow path defined by passageway 42. An upper end of dart body 56 has a low pressure dart portion 110 integrally formed with a high pressure dart portion 112. After opening of the check valve assembly 50 as seen in FIG. 5*a*, the low pressure acting on dart body 56 causes an initial sealing of the low pressure dart portion 112 against the bottom end of low pressure seat 106 (FIG. 5*b*). As the pressure rises beyond a predetermined threshold, the low pressure seat 106 is pushed upwardly against the wave washer 104, and the high pressure dart portion 110 seals against the high pressure seat 100 (FIG. 5*c*). Again, the low pressure dart/seal pair 112 and 106 will remain at a low level of contact stresses even at high pressure thus protecting the dart/seal pair from yielding.

Figure 6:
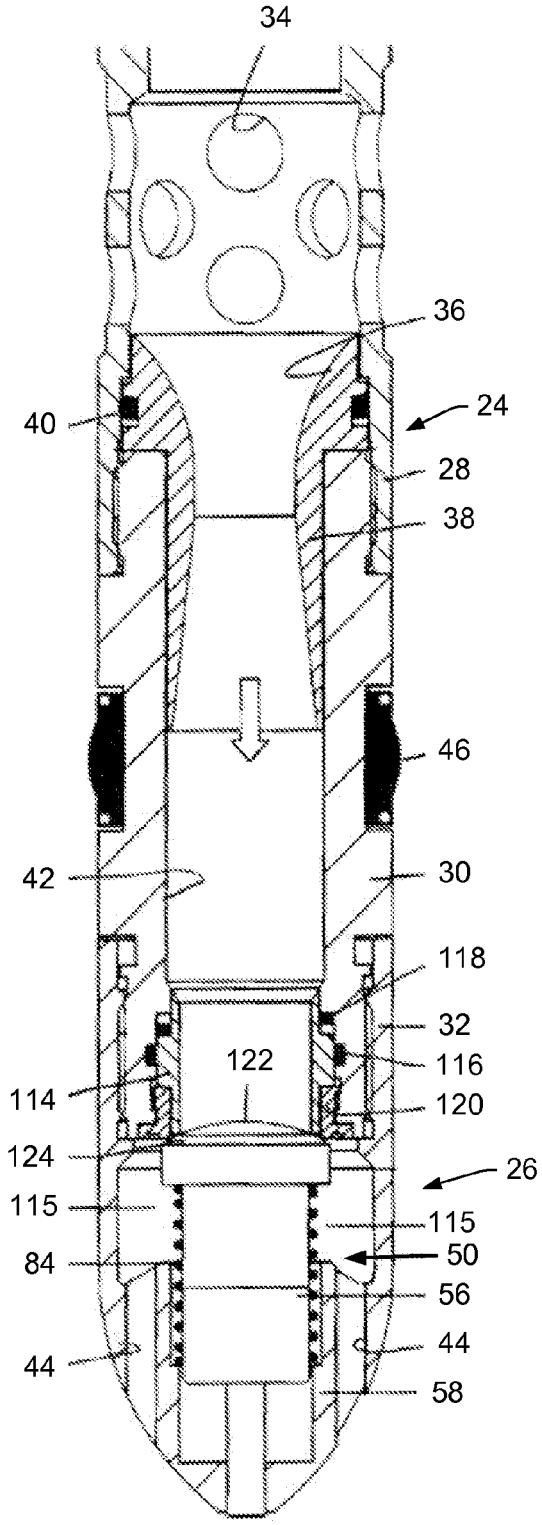
FIG. 6 is an enlarged fragmentary view of the gas lift valve of FIG. 2 with another example of the check valve arrangement.
Figure 6A:
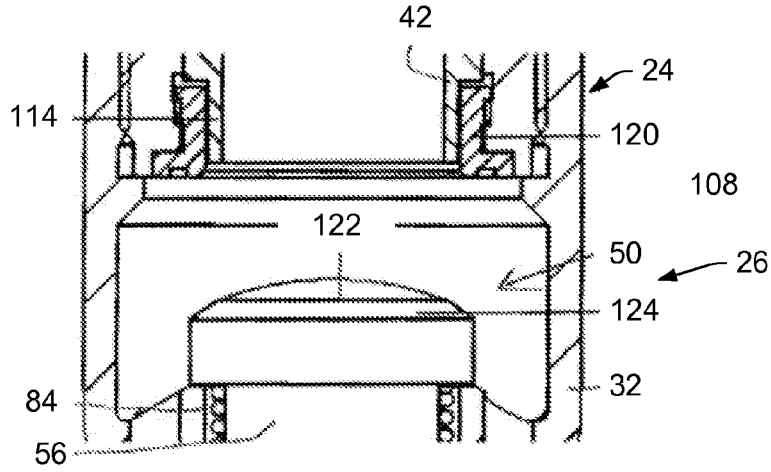
FIG. 6*a* is a partial detail view of the check valve arrangement of FIG. 6 in an open condition.
Figure 6B:
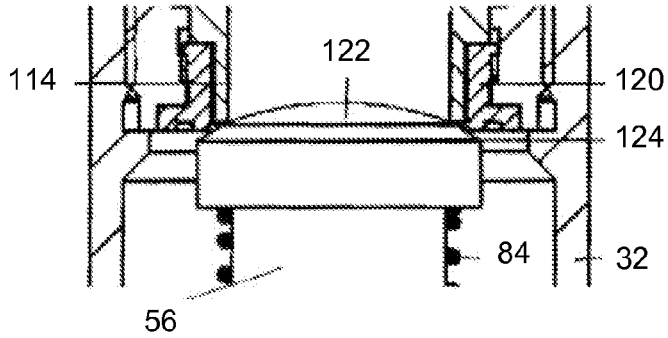
FIG. 6*b* is a partial detail view of the check valve arrangement of FIG. 6 in a low pressure sealing condition.
Figure 6C:
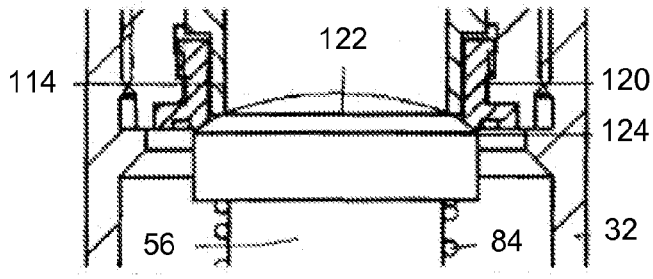
FIG. 6*c* is a partial detail view of the check valve arrangement of FIG. 6 in a high pressure sealing condition.

FIGS. 6 and 6*a*-6*c* show an additional example of a check valve arrangement 26 having an inner compliant seat check. In this example, a movable low pressure seat 114 provides an inner diameter at the bottom of passageway 42 in gas lift valve housing 30 which can be varied in size to enable greater flow of gas to a chamber 115 and the outlets 44 in the check valve housing 32. As contrasted with the low pressure seat 106 of FIG. 5, the low pressure seat 114 lies directly in the flow path of the gas lift valve 30. The low pressure 114 is surrounded by a O-ring 116 for preventing any leaks between the low pressure seat 114 and the gas lift housing 30. A wave spring 118 exerts a downward biasing force on low pressure seat 114, and a fixed high pressure seat 120 is screwed into housing 30 and provides a stop for the low pressure seat 114. Following opening of the check valve assembly 50 shown in FIG. 6*a*, low pressure causes an initial sealing of a low pressure dart portion 122 against the bottom end of low pressure 114 (FIG. 6*b*). As the pressure rises, the low pressure seat 114 is pushed upwardly against wave washer 118 and a high pressure dart portion 124 seals against the high pressure seat 120 (FIG. 6*c*).

Figure 7:
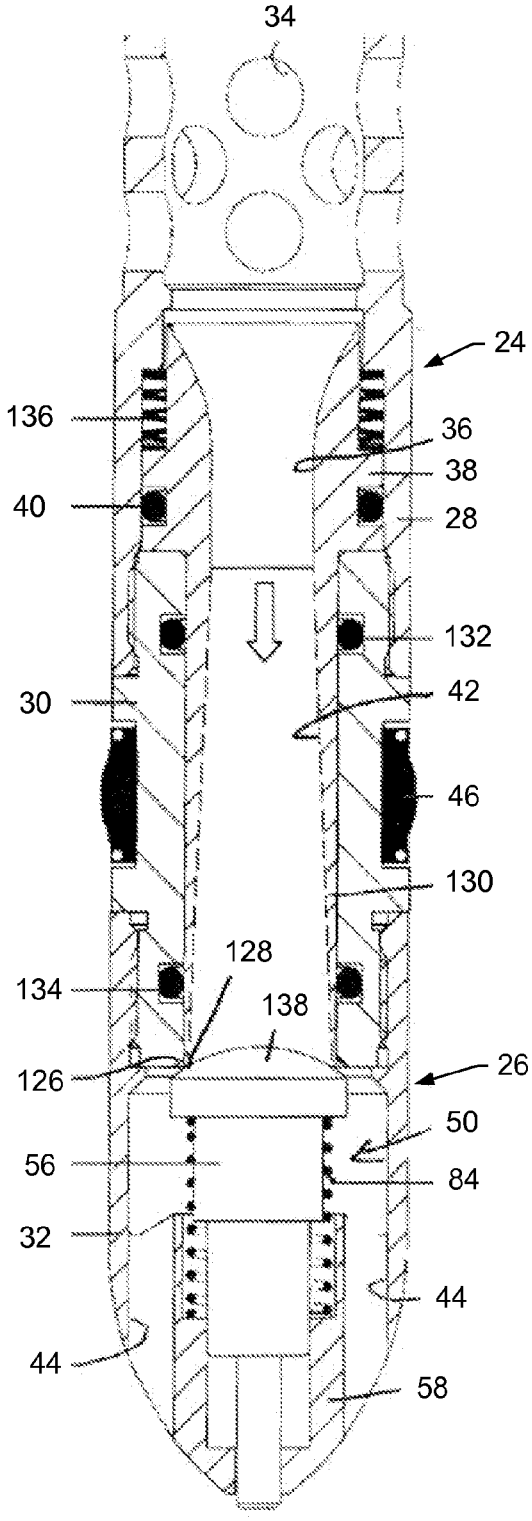
FIG. 7 is an enlarged fragmentary sectional view of a different gas lift valve with another example of check valve arrangement.
Figure 7A:
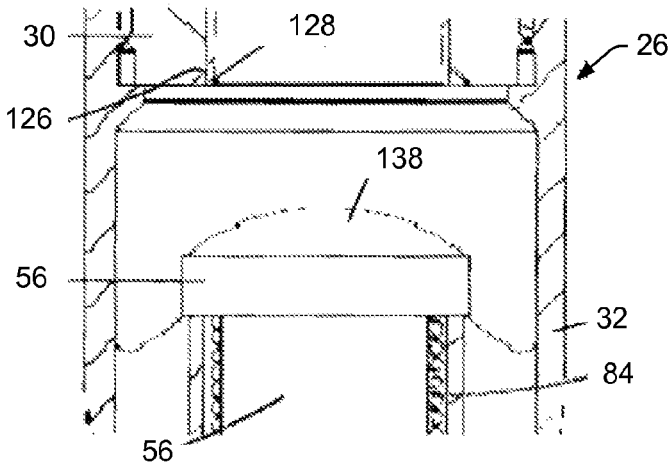
FIG. 7*a* is a partial detail view of the check valve arrangement of FIG. 7 in an open condition.
Figure 7B:
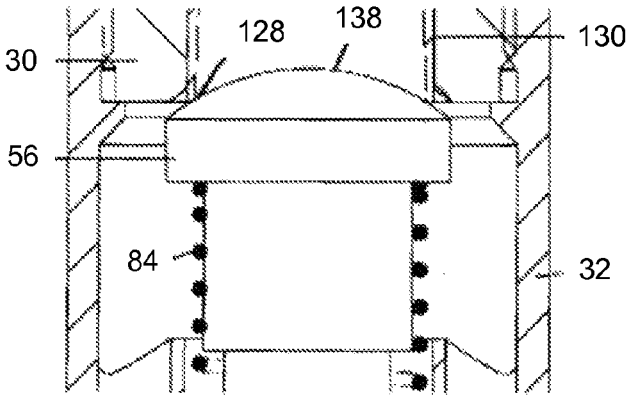
FIG. 7*b* is a partial detail view of the check valve arrangement of FIG. 7 in a low pressure sealing condition.
Figure 7C:
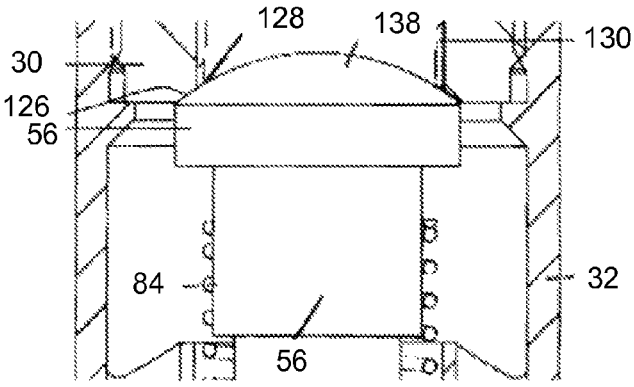
FIG. 7*c* is a partial detail view of the check valve arrangement of FIG. 7 in a high pressure sealing condition.

FIGS. 7 and 7*a*-7*c* show yet another example of a check valve arrangement 26 in which the valve seal structure has a fixed high pressure seat 126 defined by an inner surface at the bottom of tubular housing 30, and a movable low pressure seat 128 defined by a lowermost edge on an elongated portion 130 of venturi housing 38 forming passageway 42. O-rings 132, 134 are provided to seal gaps between the venturi housing 38 and the tubular housing 30. A spring 136 is interposed between respective shoulders on inlet housing 28 and venturi housing 38 to normally exert a downward biasing force on the venturi housing 38. Following opening of check valve housing 50 as shown in FIG. 7*a*, low pressure pushes a domed portion 138 of dart body 56 into engagement with low pressure seat 128 against the bias of spring 136 (FIG. 7*b*). With rising pressure, the low pressure seat 128 is pushed upwardly against spring 136 and domed portion 138 seals against high pressure seat 126 (FIG. 7*c*). If desired, dart body 56 and domed portion 138 may be replaced by a hinged flap movable in to and out of engagement with seats 126 and 128.

Figure 8:
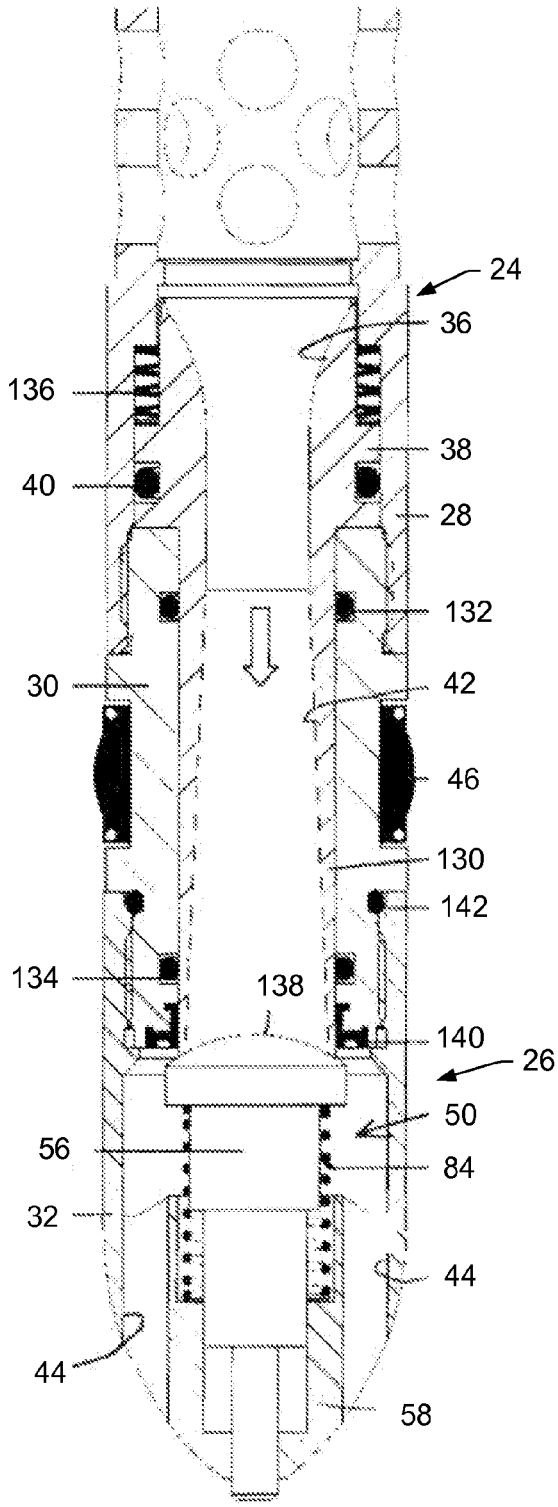
FIG. 8 is an enlarged fragmentary sectional view of a gas lift valve with another example of check valve arrangement.
Figure 8A:
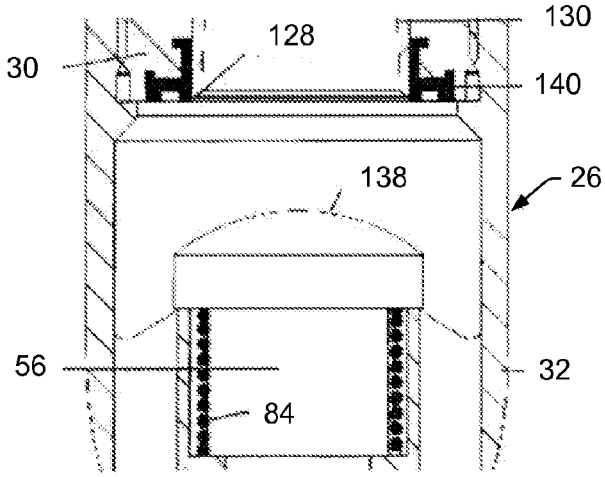
FIG. 8*a* is a partial detail view of the check valve arrangement of FIG. 8 in an open condition.
Figure 8B:
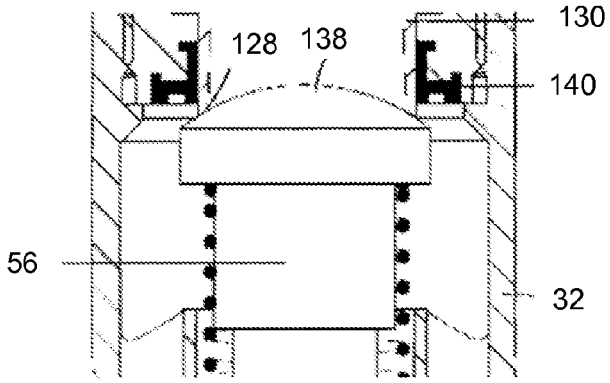
FIG. 8*b* is a partial detail view of the check valve arrangement of FIG. 8 in a low pressure sealing condition.
Figure 8C:
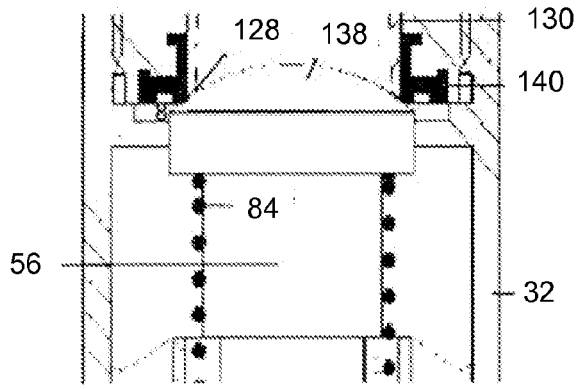
FIG. 8*c* is a partial detail view of the check valve arrangement of FIG. 8 in a high pressure sealing condition.

FIGS. 8 and 8*a*-8*c* show still another example of a check valve arrangement 26 similar to that described in FIGS. 7 and 7*a*-7*c* above except for the inclusion of a high pressure seat element 140 which may be fixed or removably attached on the bottom end of housing 30. Seat element 140 may be either formed of a rigid metallic material or a non-metallic flexible material. An O-ring 142 is disposed between the tubular housing 30 and the check valve housing 32. Following opening of check valve assembly 50 as shown in FIG. 8*a*, low pressure pushes domed portion 138 of dart body 56 into engagement with low pressure seat 128 against the bias of spring 136 (FIG. 8*b*). High pressure pushes the low pressure seat 128 upwardly and domed portion 138 seals further against high pressure seat element 140 (FIG. 8*c*).

The present disclosure thus provides a gas lift valve having a check valve arrangement that involves the use of multiple dart and seat sealing surfaces to attain a desired sealing behavior over a wide range of applied back pressures without leakage or deformation. One of the dart and/or seat sealing surfaces is preloaded by a spring or other suitable elastic element. Below a predetermined low pressure, a spring loaded pair of sealing surfaces will be in small area contact. Beyond that predetermined low pressure, a second pair of sealing surfaces will come into a large area contact. The first pair of sealing surfaces will remain at all times under low level contact stresses and will not deform plastically. Although certain examples shown herein have two pairs of sealing surfaces, i.e. low pressure and high pressure darts and seats, it should be understood that the disclosure contemplates the use of more than two pairs of sealing surfaces as dictated by specific application and element size.

What is claimed is:

1. An apparatus usable with a well comprising:

a check valve housing that comprises a tubular receiver and outlets disposed about the tubular receiver; and a check valve arrangement defined by a valve element movable into and out of engagement with a valve seat, wherein the valve element comprises an elastic element and a body that comprises a recess wherein the body is slidably mounted in the tubular receiver, wherein the valve element has a first sealing structure engageable with a second sealing structure on the valve seat, wherein the first sealing structure includes a ring sealing member and a dome sealing member, wherein the dome sealing member comprises a domed portion and a stem seated in the recess of the body, wherein the ring sealing member comprises a sealing surface and a ring section, the ring section interposed between the domed portion of the dome sealing member and the body, wherein the elastic element biases the ring sealing member for axial movement with respect to the body, and wherein contact between the ring sealing member and the second sealing structure on the valve seat compresses the elastic element between the ring sealing member and the body.

2. The apparatus of claim 1, wherein the ring sealing member is movable relative to the dome sealing member.

3. The apparatus of claim 1, wherein the domed portion is engageable with the valve seat.

4. The apparatus of claim 1, wherein the valve seat has a first seat portion and a second seat portion.

5. The apparatus of claim 1, wherein the body is normally spring biased to position the domed portion against the valve seat.

6. The apparatus of claim 1, wherein the valve seat has a dual sealing structure.

7. An apparatus usable with a well comprising:

a gas lift valve including a check valve arrangement located between an annulus and a passageway of a tubing, the check valve arrangement adapted to selectively allow a fluid flow through the check valve arrangement from an inlet side of the check valve arrangement to an outlet side of the check valve arrangement, and biased to prevent a leakage flow through the check valve arrangement from the outlet side to the inlet side, the check valve arrangement being defined by a valve element movable into and out of engagement with a valve seat, wherein the gas lift valve comprises a check valve housing that comprises a tubular receiver and outlets disposed about the tubular receiver, wherein the valve element comprises an elastic element and a body that comprises a recess wherein the body is slidably mounted in the tubular receiver, wherein the valve element has a first sealing structure engageable with a second sealing structure on the valve seat, wherein the first sealing structure includes a ring sealing member and a dome sealing member, wherein the dome sealing member comprises a domed portion and a stem seated in the recess of the body, wherein the ring sealing member comprises a sealing surface and a ring section, the ring section interposed between the domed portion of the dome sealing member and the body, wherein the elastic element biases the ring sealing member for axial movement with respect to the body, and wherein contact between the ring sealing member and the second sealing structure on the valve seat compresses the elastic element between the ring sealing member and the body.

8. The apparatus of claim 7, wherein the check valve arrangement is adapted to establish one-way flow of gas from the annulus to the passageway of the tubing.

9. The apparatus of claim 7, wherein the check valve arrangement is adapted to respond to a pressure differential between the annulus and the passageway of the tubing.

10. The apparatus of claim 7, wherein the valve seat is formed by internal structure of the gas lift valve and includes a first seat portion and a second seat portion.

11. The apparatus of claim 10, wherein the dome sealing member is engageable with the first seat portion, and the ring sealing member is engageable with the second seat portion.

12. The apparatus of claim 10, wherein the first seat portion and the second seat portion are stationary.

13. The apparatus of claim 10, wherein one of the first seat portion and the second seat portion is movable relative to the other of the first seat portion and the second seat portion.

14. The apparatus of claim 10, wherein the gas lift valve has a venturi housing that forms one of the first seat portion and the second seat portion.

15. The apparatus of claim 10, wherein one of the first seat portion and the second seat portion is removable from and replaceable in the internal structure of the gas lift valve.

16. A check valve usable in a well comprising:

a valve element body that comprises a recess;

an elastic element; and a seat and a dart, the dart interacting with the seat to form a seal, wherein the dart comprises a dome portion and a ring portion, wherein the dart ring portion comprises a sealing surface and a ring section, the ring section being interposed between the dart domed portion and the valve element body, wherein the dart dome portion is a separate part from the dart ring portion, wherein the dart dome portion is seated in the recess of the valve element body and the dart ring portion is movably biased by the elastic element being disposed between the dart ring portion and the valve element body, and wherein contact between the ring sealing member and the second sealing structure on the valve seat compresses the elastic element between the ring sealing member and the body.

17. The check valve arrangement of claim 16 the seat having a first portion that is a and a second portion.

18. The check valve arrangement of claim 17, wherein the first portion is a separate part from the second portion.

19. The check valve arrangement of claim 17, wherein the first portion is integral with the second portion.

* * * * *